United States Patent [19]

Yamashita et al.

[11] 4,144,861

[45] Mar. 20, 1979

[54] FUEL SUPPLY FOR INTERNAL COMBUSTION ENGINES

[75] Inventors: Ryuichi Yamashita; Hiromitsu Matsumoto, both of Hamamatsu; Masato Eda, Iwata, all of Japan

[73] Assignee: Yamaha Hatsudoki Kabushiki Kaisha, Iwata, Japan

[21] Appl. No.: 685,540

[22] Filed: May 12, 1976

[30] Foreign Application Priority Data

May 17, 1975 [JP] Japan ..... 50-58862

[51] Int. Cl.[2] ..... F02N 17/00

[52] U.S. Cl. ..... 123/179 G; 123/122 AB; 123/179 H; 261/39 D; 261/23 A; 261/44 C; 261/DIG. 74

[58] Field of Search ..... 123/179 A, 179 G, 179 H, 123/119 F, 122 AB; 261/41 B, 39 D, 23 A, 44 C, 50 A, 41, DIG. 74

[56] References Cited

U.S. PATENT DOCUMENTS

| | | | |
|---|---|---|---|
| 2,707,463 | 5/1955 | Booth | 123/179 A |
| 2,711,883 | 6/1955 | Reeves | 261/41 |
| 2,905,165 | 9/1959 | Hall | 123/179 G |
| 2,915,053 | 12/1959 | Armstrong | 123/179 A |
| 2,977,948 | 4/1961 | Kittler | 261/39 D |
| 3,125,084 | 3/1964 | Hall | 123/179 G |
| 3,246,886 | 4/1966 | Goodyear et al. | 261/39 D |
| 3,278,171 | 10/1966 | Carlson | 261/39 D |
| 3,285,585 | 11/1966 | Mennesson | 261/50 A |
| 3,307,837 | 3/1967 | Winkler | 261/44 C |
| 3,562,542 | 2/1971 | Redmond | 123/179 A |
| 3,687,122 | 8/1972 | Kamo | 123/179 H |
| 3,877,448 | 4/1975 | Schmid | 123/179 A |
| 3,885,545 | 5/1975 | Charron et al. | 261/39 D |
| 3,917,760 | 11/1975 | Swatman | 261/44 C |
| 3,918,257 | 11/1975 | Hirose et al. | 123/179 G |
| 3,934,571 | 1/1976 | Mennesson | 123/179 G |
| 3,965,881 | 6/1976 | Sakurai et al. | 123/122 AB |
| 3,967,610 | 7/1976 | Ross | 261/39 D |
| 3,969,893 | 7/1976 | Sakurai et al. | 123/122 AB |

*Primary Examiner*—Martin P. Schwadron
*Assistant Examiner*—G. L. Walton
*Attorney, Agent, or Firm*—Donald D. Mon

[57] ABSTRACT

Internal combustion engine including a fuel supply system which comprises a main carburetor having an intake passage leading to a combustion chamber of the engine. The engine is further provided with a starting fuel supply device which includes a starting fuel supply passage having one end opening to atmosphere and the other end connected with the intake passage. The starting fuel supply passage is provided with a fuel discharge nozzle and a starter valve disposed downstream of the nozzle. The supply passage has a cross-sectional area which is small in relation to that of the intake passage so that adequate air flow speed can be ensured even in engine starting period.

10 Claims, 6 Drawing Figures

FUEL SUPPLY FOR INTERNAL COMBUSTION ENGINES

The present invention relates to internal combustion engines and, more particularly, to internal combustion engines which are supplied under normal operating conditions with air-fuel mixture leaner than stoichiometric ratio.

It has been recognized that, in order to decrease air-pollutant constituents in engine exhaust gas, it is recommendable to operate the engines with air-fuel mixture which is leaner than stoichiometric ratio, that is, approximately 14.8 in case of gasoline. In internal combustion engines operated with such lean air-fuel mixture, substantial amount of oxygen is contained in engine exhaust gas, so that it is possible to promote oxidization of unburnt fuel components with the oxygen remaining in the exhaust gas by providing heat insulation in engine exhaust passage so as to maintain the exhaust gas temperature, whereby pollutant unburnt constituents can further be decreased in the exhaust gas.

However, even in this type of internal combustion engines, it is still necessary to use relatively rich air-fuel mixture for engine start. Therefore, engine exhaust gas contains a relatively increased amount of unburnt constituents during engine start. Further, in this period of engine operation, there is substantially no residual air in the exhaust gas for sustaining oxidation of unburnt constituents. Moreover, it takes a certain time to have the exhaust gas temperature increased to a value adequate for promoting the oxidation of the unburnt constituents. Thus, it is very difficult in the first few minutes after engine start to attain effective decrease of unburnt constituents in the exhaust gas.

In fact, it has been recognized that a substantial part of the total air pollutant constituents are exhausted in the first few minutes after engine start, and it has been experienced that, through an operation under LA-4 test mode of Federal Test Procedure which has most widely been adopted throughout the world, the amount of pollutant emissions exhausted in the first few minutes after engine start is as large as 80 percent of total pollutant emissions throughout the test period which continues for about 30 minutes. Therefore, it is extremely important to decrease the amount of pollutant emissions exhausted during engine start.

The present invention has therefore a primary object to provide internal combustion engines which can be started with an air-fuel mixture which is leaner than that used for starting conventional engines.

Another object of the present invention is to provide internal combustion engines which can be operated with lean air-fuel mixture but is as reliable as conventional engines, and any maintenance work can be performed in a conventional manner.

Still further object of the present invention is to provide internal combustion engines which can be brought into loaded operation after engine start even before the engines are sufficiently warmed up.

According to the present invention, in order to accomplish the aforementioned objects, means is provided for attaining improved atomization of fuel supplied to engines during engine start. This means comprises a starting fuel supply passage accompanying the low speed fuel supply system. The passage has one end connected with engine intake passage and the other end opened to atmosphere. A fuel chamber is also connected to the starting fuel supply passage to maintain supply of fuel to the passage.

The starting fuel supply passage has a cross-sectional area which is small in relation to that of the engine intake passage, so that air flow of substantial flow speed can be established in the starting fuel supply passage during engine start in which the engine intake passage is substantially closed by the throttle valve. Therefore, the fuel from the fuel chamber is adequately mixed with the air flow in the starting fuel supply passage and discharged into the intake passage under a sufficiently atomized condition.

According to a preferable mode of the present invention, a shut-off type starter valve is provided in the starting fuel supply passage. In one aspect of the present invention, the starter valve is controlled in such a manner that it is automatically closed after a predetermined time during engine start. In order to attain a satisfactory atomization of fuel during engine start, it is preferable to establish a certain relationship between the diameter of the starting fuel supply passage and the diameter of the engine intake passage. Further, it is also recommendable to establish a certain relationship between the minimum cross-sectional area of the starting fuel supply passage and the displacement of the engine.

According to a further aspect of the present invention, the starter valve is spring biased into the open position and adapted to be closed under the influence of the intake suction pressure of the engine. Thermostatically operated means is provided for allowing the engine intake pressure to act on the starter valve to close it only when the engine temperature is increased beyond a predetermined value. This arrangement is effective to attain enrichment of intake mixture for a very short time interval even under a hot engine condition, so that possibility of failure of the engine to start can be effectively avoided.

In order to enable an engine to start with a relatively lean mixture, it is recommendable to facilitate vapourization of intake fuel. An effective way for attaining the improved fuel vapourization is to increase the temperature of the cylinder head in the vicinity of the intake port. Thus, when the present invention is applied to liquid cooled engines, it is preferable to constitute the cylinder head in such a manner that cooling liquid passages are omitted around the intake port. Further, the intake passage has preferably a wall thickness which is gradually decreased from the end adjacent to the cylinder head dome. In order that the intake mixture is sufficiently preheated, the intake passage may be arranged in heat-exchange relationship with the exhaust passage or engine cooling liquid passage.

The internal combustion engine in accordance with the present invention is further provided in the engine exhaust passage with reactor means in which unburnt constituents in the exhaust gas is further oxidized to form stable and innoxious compounds. According to one aspect of the present invention, the reactor means is provided by thermally insulating the exhaust passage.

It is further advisable in accordance with the present invention to provide choke valve means in the engine intake passage at the upstream side of main fuel injecting device. The choke valve is used to function under an extremely low engine temperature condition, for example, when the engine temperature is below 25° C. so that an enriched air-fuel mixture is obtained. This arrangement has been found effective to make it possible to conduct loaded engine operations even before the engine is warmed-up.

The above and other objects and features of the present invention will become apparent from the following descriptions of preferred embodiments taking reference to the accompanying drawings, in which.

Figure 1:
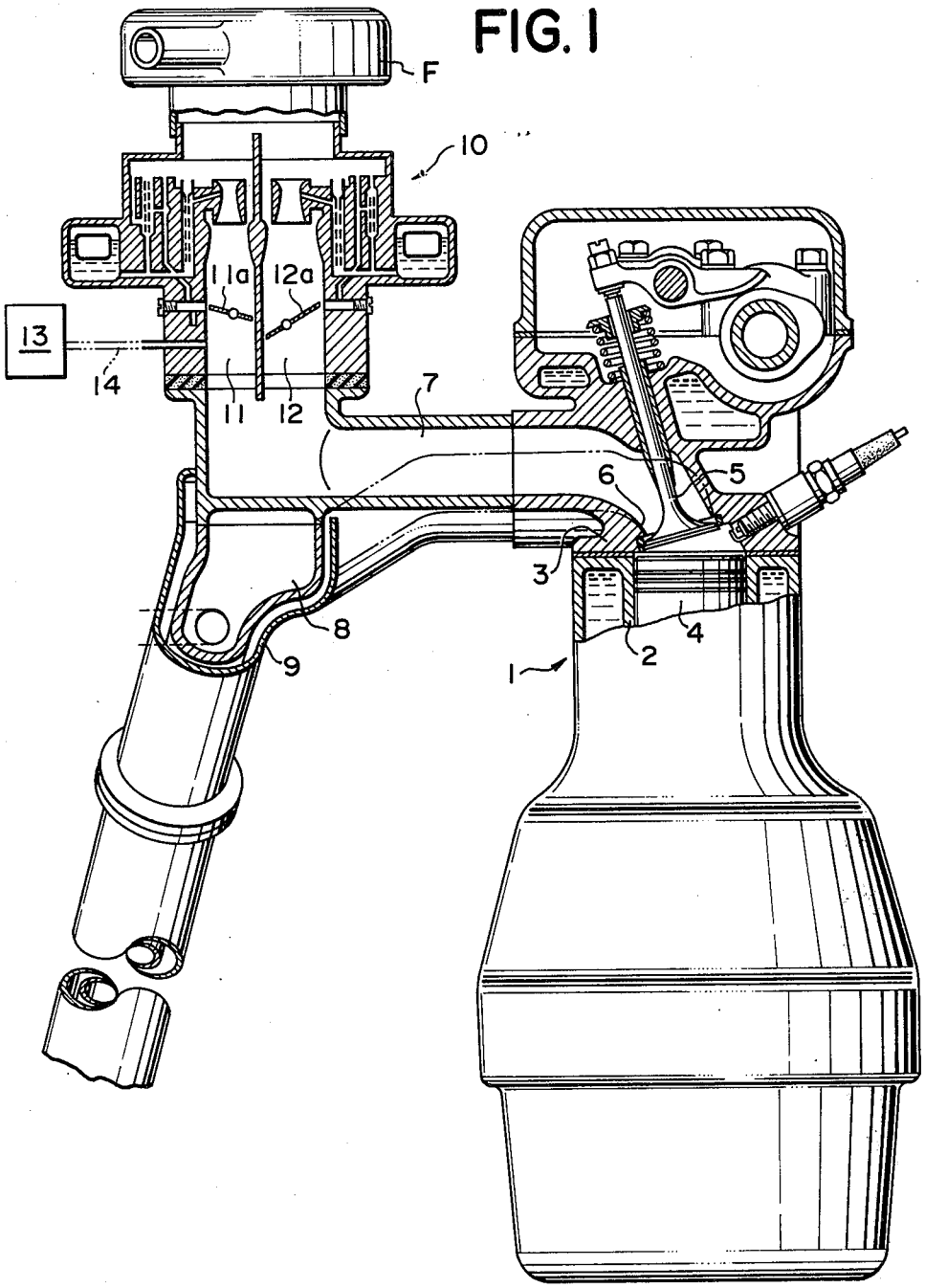
FIG. 1 is a partially sectioned side view of an internal combustion engine in accordance with the present invention.

Referring now to the drawings, particularly to FIG. 1, there is shown an internal combustion engine 1 to which the present invention can be applied. The engine 1 includes a cylinder 2, a cylinder head 3 mounted on the upper end of the cylinder 2, and a piston 4 slidably received in the cylinder 2. The cylinder head 3 is provided with an intake port 6 adapted to be closed by an intake valve 5 and also with an exhaust port (not shown) adapted to be closed by an exhaust valve which is disposed at the far side of the intake valve 5 and cannot be seen in FIG. 1. The intake port 6 is connected with an intake passage 7 and the exhaust port is connected with an exhaust passage 8. The exhaust passage 8 is thermally insulated by an insulating cover 9 surrounding the exhaust passage 8.

In communication with the intake passage 7, there is provided a carburetor which, in the illustrated embodiment, is of a composite type including a primary passage 11 and a secondary passage 12, respectively having a primary throttle valve 11*a* and a secondary throttle valve 12*a*. The passages 11 and 12 are connected with an air filter F to receive fresh air therefrom. The primary throttle valve 11*a* is connected to a manual control mechanism (not shown) and the secondary throttle valve 12*a* is associated with an automatic control device (not shown) which serves to open it in high load operation of engine. In the illustrated engine, there is provided a starting fuel supply device 13 in addition to the carburetor 10. As shown in FIG. 1, the starting fuel supply device 13 is connected with the intake passage 7 through a starting fuel supply passage 14 which opens to the primary intake passage 11 downstream of the primary throttle valve 11*a*.

Figure 2:
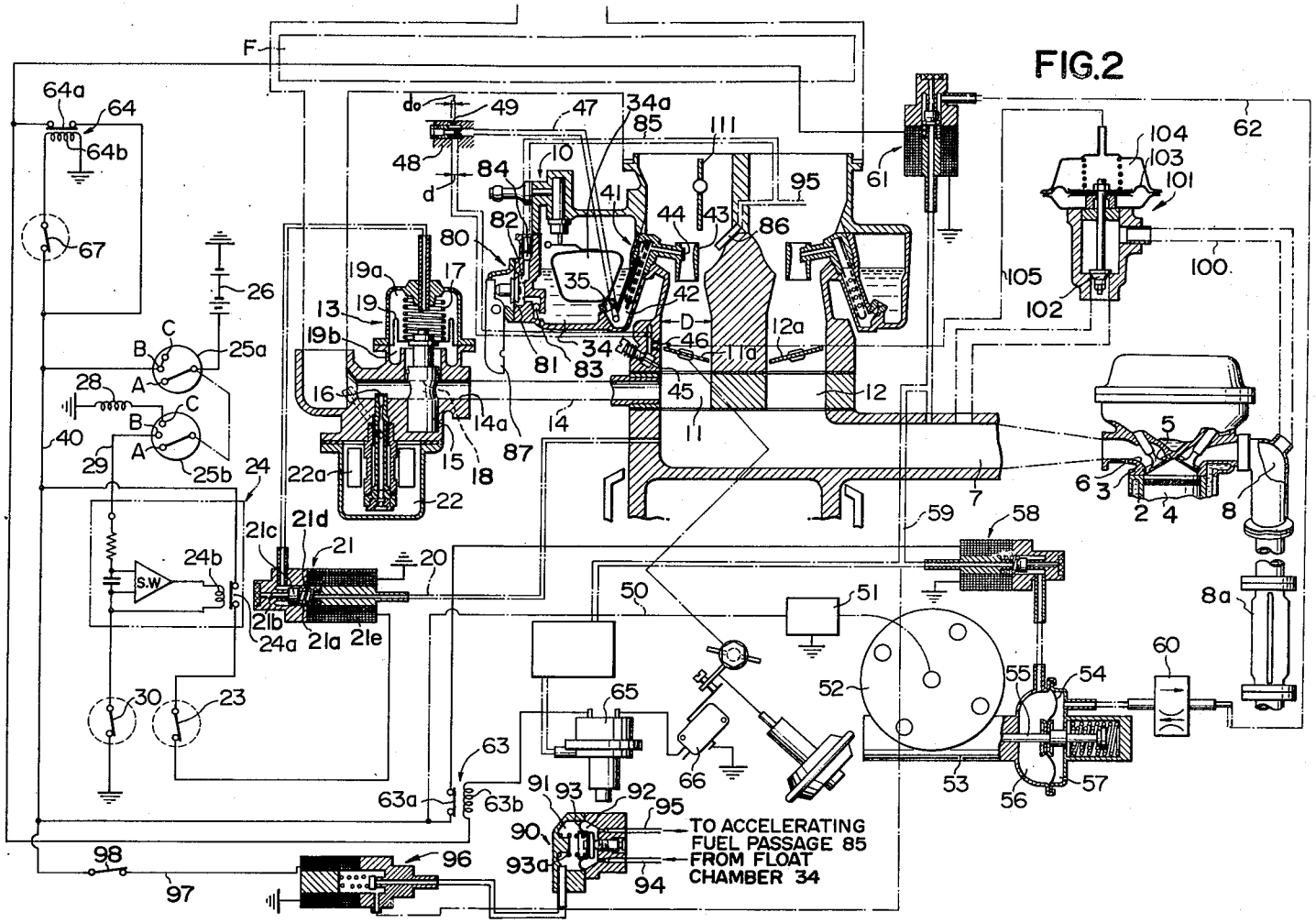
FIG. 2 is a schematic diagram of the engine control system embodying the features of the present invention.

FIG. 2 shows the fuel supply system and the ignition system employed in the engine shown in FIG. 1. The starting fuel supply device 13 includes an intake barrel 14*a* which is connected on one hand with the starting fuel supply passage 14 and on the other hand with the air filter F which is shown by phantom lines in FIG. 2. In the intake barrel 14*a*, there is provided a starter valve 15 which has a through-hole 18 and can be moved perpendicularly to the intake barrel 14*a* between an open position in which the hole 18 aligns with the intake barrel 14*a* and a closed position in which the barrel 14*a* is blocked thereby.

The starter valve 15 has one end connected with a diaphragm 19 which defines a suction pressure chamber 19*a* at one side and an atmospheric pressure chamber 19*b* at the other side. In the suction pressure chamber 19*a*, there is disposed a compression spring 17 for biasing the diaphragm 19 downwardly as seen in FIG. 2. The suction pressure chamber 19*a* is connected with the intake passage 7 through a suction pressure line 20 which has a solenoid valve 21.

The solenoid valve 21 comprises a valve chamber 21*a* which is on one hand connected with the intake passage 7 and on the other hand with the suction pressure chamber 19*a*. The valve chamber 21*a* is also opened to atmosphere through a port 21*b*. A valve member 21*c* is disposed in the valve chamber 21*a* and biased by a spring 21*d* to a position in which the port 21*b* is closed. The valve 21 further includes a solenoid coil 21*e* which when energized displaces the valve member 21*c* against the action of the spring 21*d* to open the port 21*b*. Thus, when the solenoid coil 21*e* is de-energized, suction pressure is introduced from the intake passage 7 through the line 20 to the chamber 19*a* but, when the solenoid coil 21*e* is energized, the chamber 19*a* is opened to atmosphere.

In FIG. 2, it will be seen that the hole 18 in the starter valve 15 is so located that it is registered with the intake barrel 14*a* when the starter valve 15 is moved downward under the influence of the spring 17. Therefore, when the solenoid valve 21 is energized or the pressure in the intake passage 7 is above a predetermined value such as when the engine is stationary or being cranked for start, the diaphragm 19 is forced downward by the spring 17 under the starter valve 15 is displaced to the open position in which the hole 18 aligns with the intake barrel 14*a*.

When the solenoid valve 21 is de-energized and the pressure in the intake passage 7 is below a predetermined value, suction pressure prevails in the chamber 19*a* so that the diaphragm 19 is displaced upwards against the influence of the spring 17 to close the intake barrel 14*a* by the starter valve 15.

The starting fuel supply device 13 further includes a float chamber 22 having a float 22*a* therein. A starting fuel injection nozzle 16 is provided in such a manner that it draws fuel from the float chamber 22 and discharges into the intake barrel 14*a*. It should be noted in FIG. 2 that the passage 14 and the barrel 14*a* provide a substantially straight path for starting fuel. This is advantageous in that flow resistance can be reduced to minimum.

The solenoid coil 21*e* of the valve 21 is connected through a thermostatically operated switch 23, a normally closed relay contact 24*a* of a time delay relay 24 and a first power switch 25*a* with an electric power source 26. The relay contact 24*a* is under control of a relay coil 24*b* which is on one hand connected through a line 29 and a second power switch 25*b* with the power source 26 and on the other hand grounded through a thermostatically operated switch 30. The first and second power switches 25*a* and 25*b* which are connected together have contacts A, B and C. The contacts A in both switches are open, while the contacts B and C in the switch 25*a* are connected with a line 40 which leads to the relay contact 24*a* of the time delay relay 24. The contact B of the switch 25*b* is connected with a line 29 which is connected through a timing circuit with the relay coil 24*b*, and the contact C is connected with a starter motor 28.

The thermoswitch 23 is so designed that it is closed when the engine temperature is below a first predetermined value, for example, below 45° C. in terms of engine cooling liquid temperature. The thermoswitch 30 is so designed that it is closed when the engine temperature is above a second predetermined value, for example, above 15° C. in terms of engine cooling liquid temperature. The time delay relay 24 is so constructed that the relay coil 24b is energized to open the relay contact 24a after a predetermined time when the contact B of the switch 25b is closed and the contact C is opened.

The carburetor 10 includes a float chamber 34 having a float 34a, the bottom part of the float chamber 34 being connected through a main fuel jet 35 with the lower end of a main fuel passage 42 which is provided with a conventional air bleed device 41. The upper end of the main fuel passage 42 is connected with a main fuel nozzle 44 opening to a small venturi 43 provided in the primary intake passage 11 of the carburetor 10. The primary passage 11 is further provided with an idle fuel port 45 and slow fuel ports 46 in the vicinity of the throttle valve 11a. These ports 45 and 46 are connected through a slow speed fuel passage 47 with the lower part of the main fuel passage 42. The slow speed fuel passage 47 is provided with a pilot jet 48 which is in communication with an air passage having a restriction 49.

The carburetor 10 is also provided with an accelerating fuel pump 80 which comprises a diaphragm 81 defining a pump chamber 82. The pump chamber 82 is on one hand connected with the float chamber 34 through a check valve 83 and on the other hand with an accelerating fuel passage 85 through a check valve 84. The passage 85 is connected with a fuel nozzle 86 opening to the primary passage 11 in the vicinity of the venturi device 43. A diaphragm actuating lever 87 is provided in such a manner that it is interconnected with the throttle valve 11a to be actuated thereby so that additional fuel is supplied through the passage 85 and the nozzle 86 into the primary passage 11 of the carburetor 10 for acceleration when the throttle valve 11a is rapidly opened.

There is also provided a second accelerating fuel pump 90 which comprises a suction pressure chamber 91 and a pump chamber 92 which are separated by a diaphragm 93. The pump chamber 92 is on one hand connected through a fuel line 94 with the float chamber 34 and on the other hand through a fuel line 95 with the accelerating fuel passage 85 leading to the nozzle 86. The suction chamber 91 is connected with the engine intake passage 7 through a solenoid valve 96 having a solenoid coil 96a which is energized through a line 97 having a thermostatically operated switch 98 and connected with the line 40. A spring 93a is provided in the chamber 91 so as to force the diaphragm 93 toward the pump chamber 92.

The switch is closed when the engine temperature is below a predetermined value, for example, about 60° C. in terms of the engine cooling liquid temperature. Thus, when the engine temperature is below the aforementioned predetermined value, the solenoid valve 96 is opened and the intake suction pressure in the intake passage 7 is thus introduced into the suction pressure chamber 91. When the engine throttle valve 11a is rapidly opened for acceleration, there will be a sudden decrease in the pressure in the intake passage 7 so that the diaphragm 93 will be shifted toward left as seen in FIG. 2 against the influence of the spring 93a to increase the volume of the pump chamber 92. As the intake pressure gradually increases, the diaphragm 93 is displaced toward right under the action of the spring 93a so that an additional amount of fuel is supplied through the line 95 and the nozzle 86 to the intake passage 11.

The mechanical accelerating pump 80 functions to supply accelerating fuel immediately after the engine throttle valve 11a is rapidly opened ut the supply of the additional fuel is soon terminated. In an engine which is operated with relatively lean air-fuel mixture, it has been found that it is very difficult to obtain a smooth acceleration solely by this mechanical accelerating pump particularly when the engine temperature is low. The second or suction pressure operated pump 90 is effective to maintain the supply of additional fuel for a relatively long period. Therefore, according to the present invention, the pump 90 is used to function under a low engine temperature condition for ensuring a smooth acceleration.

The engine ignition system includes a line 50 connected with a line 40 leading from the first power switch 25a, and an ignition circuit 51 provided in the line 50. The ignition circuit 51 is under control of a centrifugal ignition timing control device 52 which serves to control the ignition timing in accordance with the engine speed. The control device 52 is provided with an actuator 53 which provides an additional control of the ignition timing. The actuator 53 includes a push rod 55 having one end connected with a diaphragm 54. The push rod 55 is so arranged that the ignition timing is retarded when it is moved leftwards and advanced when it is moved rightwards.

The diaphragm 54 defines a retarding chamber 56 and an advancing chamber 57 at the opposite sides thereof. The chamber 56 is connected with the intake passage 7 through a suction pressure passage 59 having a solenoid valve 58. The chamber 57 is connected with the intake passage 7 through a suction pressure passage 62 having a one-way restriction device 60 and a solenoid valve 61.

The solenoid valves 58 and 61 are of the same type as the solenoid valve 21 and serve to open the respective chambers 56 and 57 to atmosphere when energized but to connect them to the intake passage 7 when de-energized.

The solenoid valve 58 has a solenoid coil which is connected with the line 40 through a normally opened contact 63a of a relay 63. The relay 63 has a solenoid coil 63b which is on one hand connected with the power source 26 through a normally closed contact 64a of a relay 64 and the contact B of the first power switch 25a, and on the other hand grounded through a pressure switch 65 and a throttle actuated switch 66. The pressure switch 65 is responsive to the pressure in the intake passage 7 and closed when the pressure is above a certain value, for example −500 mmHg. The switch 66 is so arranged that it is closed when the engine throttle valve 11a is closed.

The relay 64 has a solenoid coil 64b which is connected with the power source 26 through a thermostatically operated switch 67 and the contact B of the first power switch 25a. The switch 67 is closed when the engine temperature is below a predetermined value, for example, below 60° C. in terms of the engine cooling liquid.

The one-way restriction device 60 is so designed that it does not provide any restriction to the air flow from the chamber 57 to the solenoid valve 61 but restricts the flow in the opposite direction. The solenoid coil of the valve 61 is connected through the contact 64a of the relay 64 so that it is energized when the engine temperature is above the aforementioned predetermined value under which the switch 67 is opened.

Thus, since the switch 67 is maintained in the close position to energize the coil 64*b* of the relay 64 until the engine temperature is increased beyond the aforementioned value after engine start, the solenoid valve 61 serves to connect the intake passage 7 to the chamber 57. Since the coil 63*b* of the relay 63 is also de-energized, the contact 63*a* is closed and the solenoid valve 58 opens the chamber 56 to the atmosphere. Thus, the push rod 55 is shifted toward right and the ignition timing is generally advanced.

As the engine temperature increases to a value wherein the switch 67 is opened, the contact 64*a* of the relay 64 is closed and the coil of the solenoid valve 61 is energized. When the throttle valve 11*a* is opened, the switch 66 is also opened to de-energize the coil 63*b* of the relay 63. Thus, the contact 63*a* is closed and the coil of the solenoid valve 58 is energized. Therefore, atmospheric pressure is introduced into both of the chambers 56 and 57 to maintain the push rod 55 substantially in the neutral position.

When the throttle valve 11*a* is closed in this situation, the coil 63*b* of the relay 63 is energized to open the contact 63*a*. Thus, the solenoid valve 58 is de-energized so that it connects the chamber 56 with the intake passage 7. The pressure in the chamber 56 is therefore decreased and the push rod 55 is displaced toward left so that the ignition timing is retarded. Since the restriction device 60 serves to restrict the air flow to the chamber 57, the leftward movement of the push rod 55 is made relatively slowly.

According to the embodiment shown in FIG. 2, there is provided means for recirculating a part of the engine exhaust gas to the intake passage 7 for the purpose of decreasing $NO_x$ content in the exhaust gas under a loaded operation of the engine. For this purpose, an exhaust gas recirculating pipe 100 is provided to extend between the exhaust passage 8 and the intake passage 7. A control valve 101 is provided in the pipe 100 so that the amount of recirculation gas is controlled in accordance with the engine load. The control valve 101 includes a valve member 102 which is connected with a diaphragm 103. The diaphragm 103 defines a suction pressure chamber 104 at one side thereof, the chamber 104 being connected through a line 105 with the intake passage 11 of the carburetor 10 slightly upstream of the throttle valve 11*a*. Thus, as the throttle valve 11*a* is opened, the diaphragm 103 of the valve 101 is gradually shifted upwardly to open the valve so that the exhaust gas in the exhaust passage 8 is allowed to flow into the intake passage 7.

In accordance with the embodiment of the present invention, the starting fuel supply system operates in the following manner. During engine start, the contact 24*a* of the time delay relay 24 is in the closed position and the switch 23 is closed as far as the engine temperature is below a certain value, for example 45° C. in terms of the engine cooling liquid temperature. Thus, the solenoid valve 21 is energized to open the chamber 19*a* to atmosphere when the contact B of the power switches 25*a* and 25*b* are closed. Therefore, the starter valve 15 is displaced downwardly under the influence of the spring 17 until the hole 18 is aligned with the intake barrel 14*a*. Air is thus drawn under the influence of the intake suction pressure in the intake passage 11 through the supply passage 14. Fuel is also drawn from the float chamber 22 to the intake barrel 14*a* through the nozzle 16 and mixed with the air flowing through the intake barrel 14*a* and the supply passage 14, to be supplied through the passages 11 and 7 into the cylinder 2. Since the starting fuel supply passage 14 has a cross-sectional area which is small in relation to that of the passage 11, it is possible to maintain adequate level of flow speed therein to ensure adequate atomization of the fuel from the nozzle 16. Thus, it is possible to perform engine start with a relatively lean air-fuel mixture. The illustrated arrangement of the starting fuel supply device 13 is further advantageous in that the starter valve 15 is normally retained in the open position when the engine is stationary. Therefore, even under hot or warm engine temperature condition, the starter valve 15 is opened to supply additional mixture to the engine during engine start until combustion takes place. Thus, engine start can be performed without fail even with a relatively lean mixture.

Recommendably, the supply passage 14 is of such a dimension that the ratio of the cross-sectional area of the passage 14 to the displacement of the engine is between 0.01 and 0.03. If the cross-sectional area is less than the value, there will be an adverse increase in the flow resistance in the passage 14 so that it will not be possible to ensure an adequate amount of intake air. If the cross-sectional area is larger than this value, it will not be possible to ensure an adequate flow speed required for attaining a satisfactory fuel atomization.

With the engine cooling liquid temperature above 15° C., the thermoswitch 30 is closed so that the coil 24*b* of the time delay relay 24 is energized to open the contact 24*a* after a predetermined time from engine start. Thus, the solenoid valve 21 is de-energized and the chamber 19*a* is connected with the intake passage 11. The intake suction pressure is then introduced into the chamber 19*a* and the diaphragm 19 is thus shifted upwardly under the influence of the suction pressure in the chamber 19*a* to move the starter valve 15 to the close position.

The time when the starter valve 15 is closed shall be determined taking into consideration the time required for having the exhaust gas reactor in the exhaust system start to function. In this particular embodiment, the engine is normally supplied with air-fuel mixture which is leaner than the stoichiometric ratio so that the exhaust gas generally contains adequate amount of surplus oxygen which can be utilized for combustion of unburnt constituents. Therefore, the reactor can be constituted simply by a thermal insulating cover 9 which encircles the exhaust passage 8, however, it should be noted herein that the effect of the reactor can remarkably be increased by employing a conventional thermal reactor including a catalytic device 8*a*.

Under a very cold engine temperature condition such as an engine cooling liquid temperature below 15° C., the thermoswitch 30 is in the open position and the coil 24*b* of the time delay relay 24 is de-energized, so that the contact 24*a* is maintained in the closed position and therefore the starter valve 15 is kept open. In this instance, as soon as the engine cooling liquid temperature reaches 15° C., the switch 30 is closed and, after the aforementioned predetermined time from the instance, the coil 24*b* of the relay 24 is energized to open the contact 24*a* and move the starter valve 15 to the closed position.

After the starter valve 15 is closed, fuel is supplied through normal fuel supply systems including the main fuel nozzle 40, the idle port 45 and the slow ports 46.

When the throttle valve 11a is in the closed position or in the slightly open position, fuel is supplied through the slow speed fuel supply passage 47 to the idle port 45 and the slow ports 46 to be discharged to the intake passage 11. Air is drawn from the restriction 49 through the pilot jet 48 to the supply passage 47 to be mixed with the fuel therein and discharged through the ports 45 and 46.

It is preferred in order to obtain an improved atomization of fuel to establish a certain dimensinal relationship among the diameter D of the intake passage 11 in the vicinity of the throttle valve 11a, the maximum diameter d of the slow speed fuel supply passage 47 and the diameter do of the restriction 49. According to the present invention, the proposed relationship is as follows:

$do/D = 0.035\text{–}0.065$ $d/D = 0.035\text{–}0.100$

Figure 4:
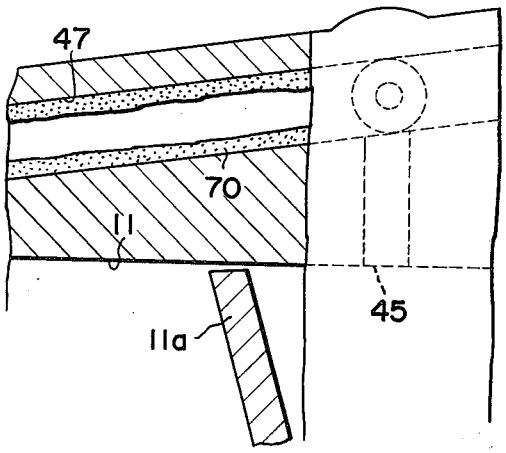
FIGS. 4 and 5 are sectional views of slow speed fuel passages for showing flow of fuel therein.
Figure 5:
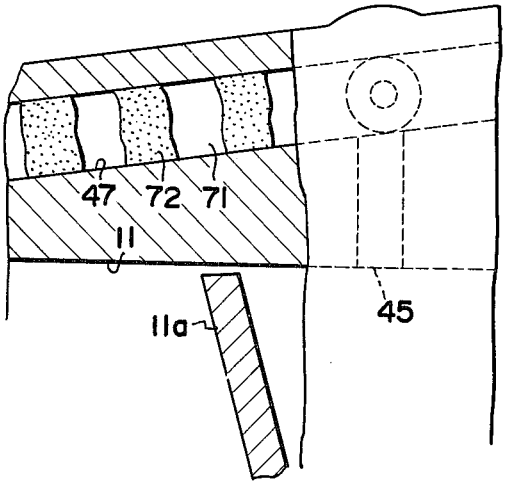

It has been found that, when the above relationship is met, fuel in the slow fuel supply passage 47 constitutes a cylindrical flow 70 flowing along the wall surface of the supply passage 47 with air flow along the center axis thereof as shown in FIG. 4. This type of flow is advantageous in that the fuel is satisfactorily dispersed into fine particles when it is discharged from the ports 45 and 46. When the above requirement is not met, there will be an intermittent fuel flow 72 with air layers 71 disposed between the fuel blocks as shown in FIG. 5. In this instance, fuel is intermittently discharged into the intake passage without being satisfactorily atomized.

According to the present invention, the slow speed fuel supply passage 47 is constructed as described above, atomization of fuel can be significantly improved under a low speed engine operation. Thus, low speed engine operation can be performed with air-fuel mixture which is leaner than that used in conventional engines, so that it is possible to decrease the amount of unburnt constituents in the exhaust gas.

With a higher engine temperature, for example, with the engine cooling liquid temperature above 45° C., the thermoswitch 23 is in the open position so that the solenoid valve 21 is de-energized. Therefore, the starting fuel supply device 13 is out of function and the engine start is performed only with the fuel supplied through the slow speed fuel supply system.

The starting fuel supply device 13 in accordance with the present invention is found as being particularly effective to significantly decrease the unburnt constituents in the exhaust gas, such as hydrocarbon and carbon monoxide. Since the starting fuel supply device 13 is brought out of function after a predetermined time from engine start, the amount of the unburnt constituents can further be decreased.

Figure 6:
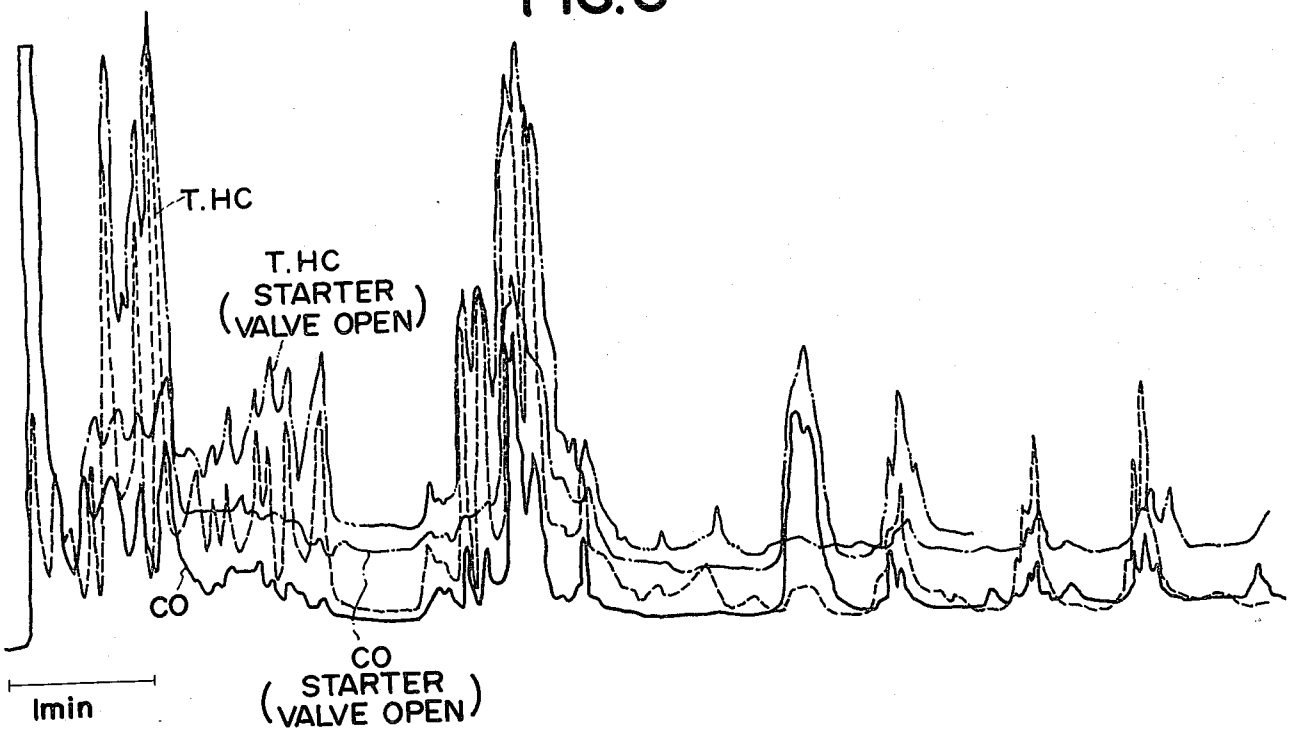
FIG. 6 is a diagram for showing the amount of pollutant emissions in the engine exhaust gas.

The effect of the timed cut-off of the starting fuel supply device 13 is shown in FIG. 6. Referring to FIG. 6, the amounts of total hydrocarbon and carbon monoxide change as shown by chain lines when the device 13 is continued to function, while the amounts change as shown by a solid line and a dotted line when the device 13 is brought out of operation after a certain period from engine start.

When the present invention is applied to liquid-cooling type engines, the cylinder head 3 is so formed that it is free from liquid jacket in the vicinity of the intake port 6. Further, the intake passage is gradually decreased in wall thickness from the intake port 6 to the carburetor 10. This has been found as being effective to increase the temperature of the intake port area so that improved fuel vapourization can be ensured.

According to a further preferred mode of the present invention, a choke valve 110 is provided in the primary passage 11 upstream of the venturi device 43 in order that a loaded operation can be performed under a very low engine temperature condition. Further, the engine is also provided with a mechanism for slightly increasing the idle opening of the throttle valve 11a.

Figure 3:
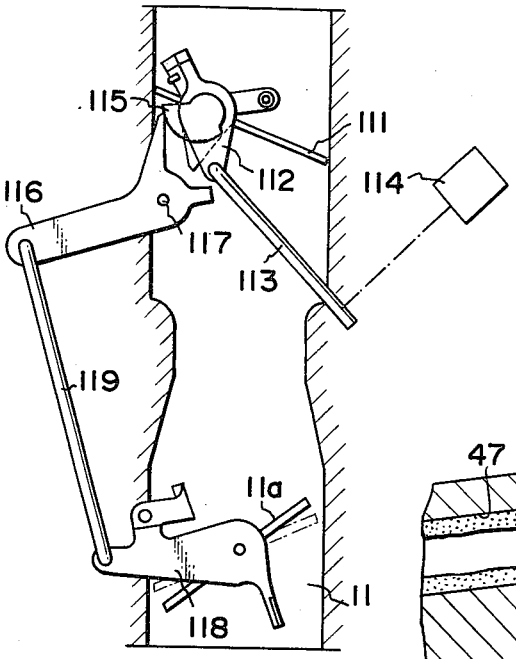
FIG. 3 is a diagrammatical sectional view specifically showing a mechanism for maintaining the engine throttle valve in slightly open position when the choke valve is closed.

Referring specifically to FIG. 3, the choke valve 111 is connected with a lever 112 which is in turn connected with an actuating rod 113. The rod 113 is controlled by a thermostatically operated timing device 114 which is so designed that it maintains the choke valve 111 in the close position under the engine cooling liquid temperature above a first predetermined value, but gradually opens the choke valve 111 in accordance with the engine temperature when the engine cooling liquid temperature is above the first value but below a second predetermined value, and maintains in the full open position under the engine cooling liquid temperature above the second value. For the purpose of example, the first value may be 15° C. and the second value may be 25° C.

A cam 115 is provided on the lever 112 for cooperation with a lever 116 pivotably mounted on a pin 117. The throttle valve 11a has an actuating lever 118 which is connected with the lever 116 by a rod 119. The cam 115 is so shaped that it pivots the lever 116 counterclockwise about the pin 117 when the choke valve 111 is closed so as to increase the idle opening of the throttle valve 11a as shown by the solid line in FIG. 3. As the choke valve 111 is opened, the idle opening of the throttle valve 11a is gradually decreased as shown by broken lines in FIG. 3.

The invention has thus been shown and described with reference to a specific embodiment, however, it should be noted that the invention is in no way limited to the details of the illustrated embodiment but changes and modifications may be made without departing from the scope of the appended claims.

We claim:

1. Internal combustion engine comprising intake passage means leading to combustion chamber means and provided with throttle valve means, main carburetor means for providing a supply of air-fuel mixture, starting fuel supply means having starting fuel supply passage means of a cross-sectional area which is small in relation to that of the intake passage means and opening at one end to the intake passage means downstream of the throttle valve means and at the other end to atmosphere, starting fuel discharge means discharging starting fuel into said starting fuel supply passage means so that the fuel discharged from the starting fuel discharge means to the starting fuel supply passage means is mixed with air passing therethrough to form an air-fuel mixture, starting valve means provided in the starting fuel supply passage means downstream of the starting fuel discharge means, said starting valve means being connected with a movable wall defining a vacuum chamber at one side in such a manner that when a negative pressure is introduced to said vacuum chamber said starting valve means is moved to a position where it closes the starting fuel supply passage means, spring means biasing the starting valve means to an open position, means for connecting the vacuum chamber with the intake passage means at engine temperature above a predetermined value, and exhaust passage means connected with said combustion chamber means.

2. Internal combustion engine in accordance with claim 1 which further includes choke valve means provided in the intake passage means upstream of the throttle valve means.

3. Internal combustion engine in accordance with claim 2 in which said starting valve means is opened under an engine temperature below a first predetermined value, closed after a predetermined time delay when the engine temperature is between the first value and the second predetermined value which is higher than the first value, and opened under the engine temperature above the second predetermined value, said choke valve means being closed with the engine temperature below a third predetermined value, opened in accordance with the engine temperature when the engine temperature is between the third value and a fourth predetermined value and fully opened under the engine temperature above the fourth value.

4. Internal combustion engine in accordance with claim 2 which further includes means for providing a supply of additional fuel during acceleration under low engine temperature condition.

5. Internal combustion engine in accordance with claim 2 in which said starting fuel supply passage means being substantially straight and of substantially uniform cross-section between the starting fuel discharge means and the intake passage means.

6. Internal combustion engine in accordance with claim 5 in which said valve means in the starting fuel supply means being so formed that it provides an opening which can substantially be aligned with the supply passage means.

7. Internal combustion engine in accordance with claim 1 in which the ratio of minimum cross-sectional area in square milimeter of said starting fuel supply passage to engine displacement in cubic centimeter is between 0.01 and 0.03.

8. Internal combustion engine in accordance with claim 1 which is of liquid coolng type and free from cooling liquid jacket means around intake port means, cooling liquid jacket means being provided around exhaust port means, said intake passage means having wall thickness which is gradually decreased from an end adjacent to the intake port means.

9. Internal combustion engine in accordance with claim 1 which further includes slow speed fuel passage means having one end opening to the intake passage means in the vicinity of the throttle valve means, said slow speed fuel passage means being also connected with fuel supply source as well as the atmosphere through restriction means, the relationship between the diameter D of the intake passage means, the diameter do of the restriction means and the maximum diameter d of the slow speed fuel passage means being:

$do/D = 0.035$ to $0.065$ $d/D = 0.035$ to $0.100$.

10. Internal combustion engine in accordance with claim 3 in which said valve means is provided with spring means for normally biasing it to open position and means is provided for shifting the valve means under engine intake pressure when the engine temperature is above a predetermined value.

* * * * *